US006131199A

United States Patent [19]

Bugel et al.

[11] Patent Number: 6,131,199

[45] Date of Patent: Oct. 17, 2000

[54] VEST WITH INCORPORATED BACK PACK AND BACK SUPPORT

[76] Inventors: Deborah Bugel, 115 Cresta Vista Dr., San Francisco, Calif. 94127; Karen Fitzgerald, P.O. Box 9280, Santa Rosa, Calif. 95405

[21] Appl. No.: 09/515,162

[22] Filed: Feb. 29, 2000

[51] Int. Cl.[7] ..... A41D 1/04

[52] U.S. Cl. ..... 2/102; 2/94; 2/44; 224/627; 224/637

[58] Field of Search ..... 2/102, 92, 94, 2/2.5, 461, 44, 462, 467, 247, 465, 69, 85, 93, 108; 128/846, 870, 875; 224/153, 627, 637, 643, 660

[56] References Cited

U.S. PATENT DOCUMENTS 3,074,074 1/1963 Lovering ..... 2/94
5,038,779 8/1991 Barry et al. .
5,247,707 9/1993 Parker et al. .
5,450,627 9/1995 Grilliot et al. ..... 2/102
5,611,084 3/1997 Garry et al. ..... 2/93
5,634,579 6/1997 Baclawski .
5,797,143 8/1998 Buxton .
5,909,802 6/1999 Puco et al. .
5,913,409 6/1999 Test .

*Primary Examiner*—John J. Calvert
*Assistant Examiner*—Tejash Patel
*Attorney, Agent, or Firm*—Goldstein & Canino

[57] ABSTRACT

A vest with incorporated back pack and back support including a vest portion adapted for being worn on a torso of a user. The vest portion is comprised of a front panel and a back panel each having outer edges. The outer edges are secured together leaving arm receiving openings and a head receiving opening. A backpack portion is secured to the back panel of the vest portion. A lower back support is securable to the back panel of the vest portion below the backpack portion. A pair of shoulder supports are secured interiorly of the vest portion.

8 Claims, 4 Drawing Sheets

VEST WITH INCORPORATED BACK PACK AND BACK SUPPORT

BACKGROUND OF THE INVENTION

The present invention relates to a vest with incorporated back pack and back support and more particularly pertains to providing functionality of a traditional back pack while equally distributing weight loads on a person's shoulder and hips.

Typical backpacks provide very little support to the lower back. The lower back suffers great strain when a person is toting around a backpack filled with heavy objects. What is needed is a backpack that will evenly distribute this weight so that the strain on the lower back is not nearly as great.

The present invention attempts to solve the abovementioned problem by providing a device that will allow one to carry heavy weight while at the same time limit the stress on a single part of the body.

The use of vests and back packs is known in the prior art. More specifically, vests and back packs heretofore devised and utilized for the purpose of allowing for a person to carry multiple items on their back are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,247,707 to Parker et al. discloses a utility vest with an integrally carried pack. U.S. Pat. No. 5,909,802 to Puco et al. discloses a vest backpack including a hood and a mack. U.S. Pat. No. 5,797,143 to Buxton discloses a vest pack with back and neck supports. U.S. Pat. No. 5,038,779 to Barry et al. discloses a therapeutic garment for the therapeutic treatment of back pain. U.S. Pat. No. 5,634,579 to Baclawski discloses a backpack with integral vest. U.S. Pat. No. 5,913,409 to Test discloses a sportsman's vest for supporting a variety of articles used by shooters.

While these devices fulfill their respective, particular objective and requirements, the aforementioned patents do not describe a vest with incorporated back pack and back support for providing functionality of a traditional back pack while equally distributing weight loads on a person's shoulder and hips.

In this respect, the vest with incorporated back pack and back support according to the present invention substantially departs from the conventional concepts and designs of the prior art, and in doing so provides an apparatus primarily developed for the purpose of providing functionality of a traditional back pack while equally distributing weight loads on a person's shoulder and hips.

Therefore, it can be appreciated that there exists a continuing need for a new and improved vest with incorporated back pack and back support which can be used for providing functionality of a traditional back pack while equally distributing weight loads on a person's shoulder and hips. In this regard, the present invention substantially fulfills this need.

SUMMARY OF THE INVENTION

In the view of the foregoing disadvantages inherent in the known types of vests and back packs now present in the prior art, the present invention provides an improved vest with incorporated back pack and back support. As such, the general purpose of the present invention, which will be described subsequently in greater detail, is to provide a new and improved vest with incorporated back pack and back support which has all the advantages of the prior art and none of the disadvantages.

To attain this, the present invention essentially comprises a vest portion adapted for being worn on a torso of a user. The vest portion is comprised of a front panel and a back panel each having outer edges. The outer edges are secured together leaving arm receiving openings and a head receiving opening. The front panel is defined by a pair of separable equally sized portions each having inner edges. The inner edges are coupled together by a zippered closure. The back panel has a pair of slotted openings therethrough inwardly of the outer edges thereof. The front panel has a plurality of pockets and a D-ring disposed thereon. A backpack portion is secured to the back panel of the vest portion. The backpack portion has an open upper end having a zippered closure. The backpack portion has a hollow interior for receiving items therein. A lower back support is securable to the back panel of the vest portion below the backpack portion. The lower back support has a generally rectangular configuration. The lower back support is comprised of a fabric outer layer and a padded interior. The lower back support has opposed ends. The opposed ends each have a strap extending outwardly therefrom. The straps have free ends extending through the slotted openings of the back panel for wrapping around a waist of a wearer. The free ends have corresponding male and female fasteners for securement around the waist of the wearer. The straps each have a vertically oriented strap. A pair of shoulder supports are secured interiorly of the vest portion. Each of the shoulder supports include a front portion and a back portion. The back portions are fixedly secured to the back panel of the vest portion. The front portions each have a securement strap for securing to the vertically oriented straps of the lower back support. The front portions are coupled together by an adjustable strap.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vest with incorporated back pack and back support which has all the advantages of the prior art vests and back packs and none of the disadvantages.

It is another object of the present invention to provide a new and improved vest with incorporated back pack and back support which may be easily and efficiently manufactured and marketed.

It is a further object of the present invention to provide a new and improved vest with incorporated back pack and back support which is of durable and reliable construction.

An even further object of the present invention is to provide a new and improved vest with incorporated back pack and back support which is susceptible of a low cost of manufacture with regard to both materials and labor, and which accordingly is then susceptible of low prices of sale to the consuming public, thereby making such a vest with incorporated back pack and back support economically available to the buying public.

Even still another object of the present invention is to provide a new and improved vest with incorporated back pack and back support for providing functionality of a traditional back pack while equally distributing weight loads on a person's shoulder and hips.

Lastly, it is an object of the present invention to provide a new and improved vest with incorporated back pack and back support including a vest portion adapted for being worn on a torso of a user. The vest portion is comprised of a front panel and a back panel each having outer edges. The outer edges are secured together leaving arm receiving openings and a head receiving opening. A backpack portion is secured to the back panel of the vest portion. A lower back support is securable to the back panel of the vest portion below the backpack portion. A pair of shoulder supports are secured interiorly of the vest portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
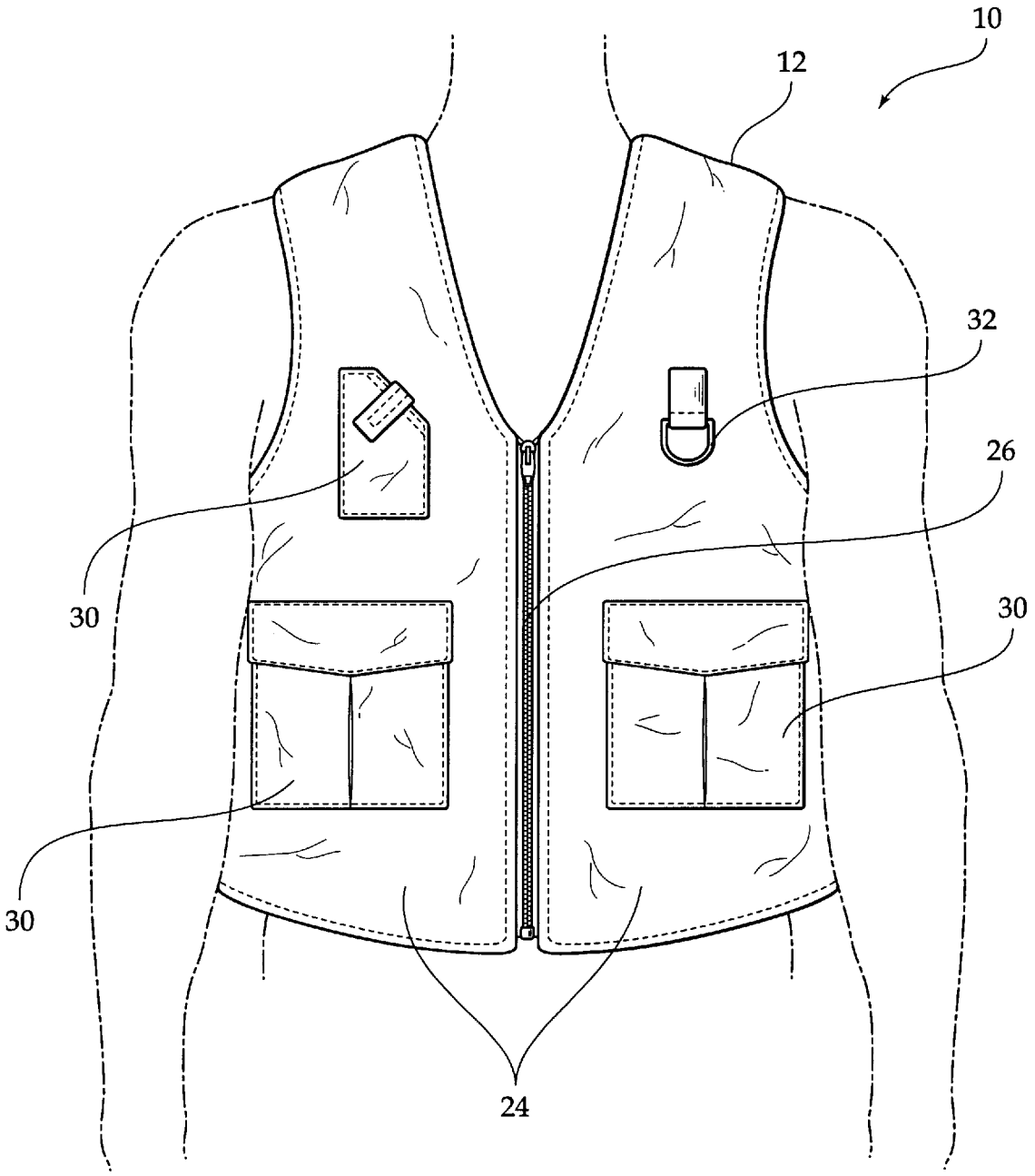
FIG. 1 is a perspective view of the preferred embodiment of the vest with incorporated back pack and back support constructed in accordance with the principles of the present invention.
Figure 2:
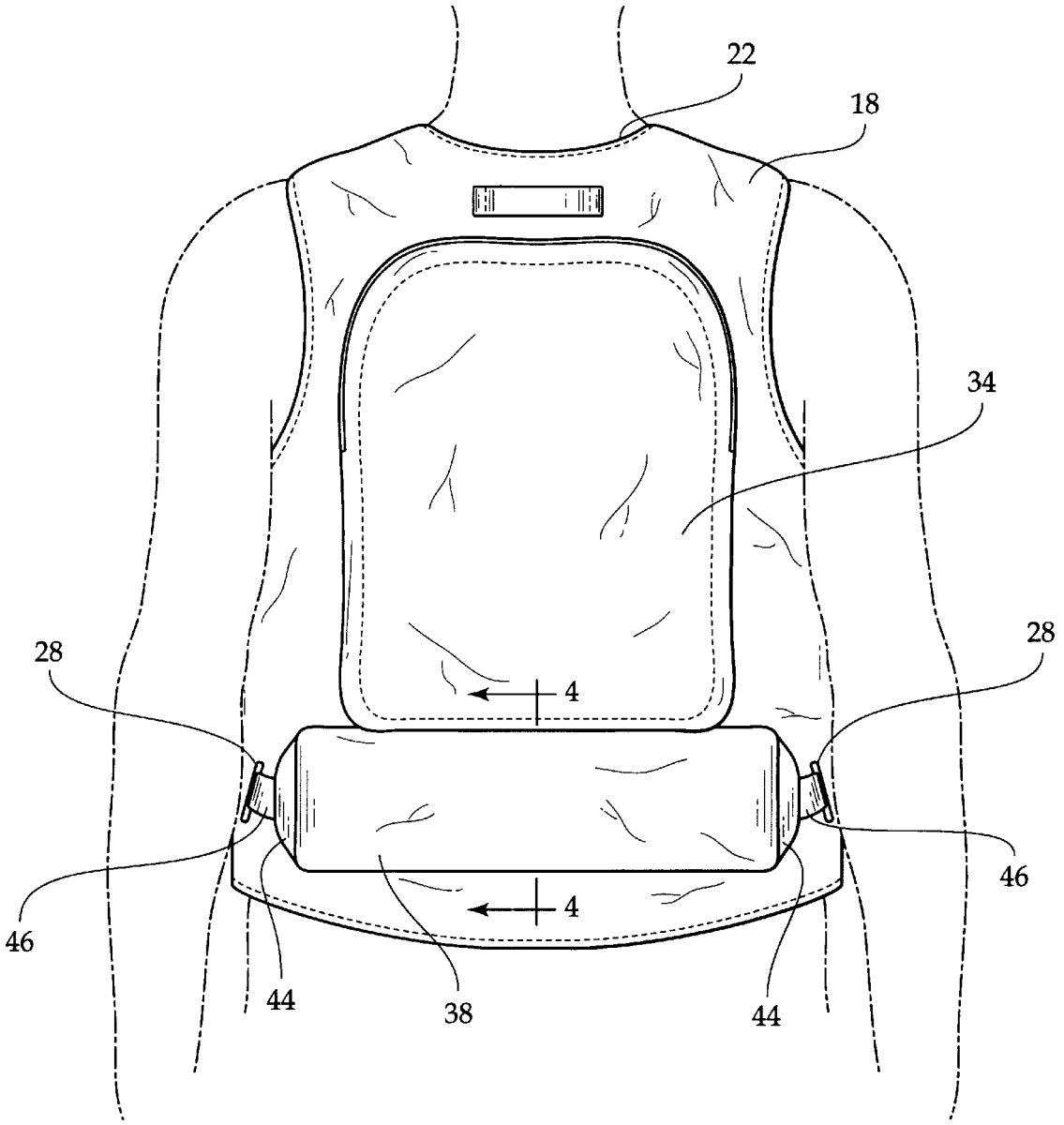
FIG. 2 is a rear view of the present invention.
Figure 4:
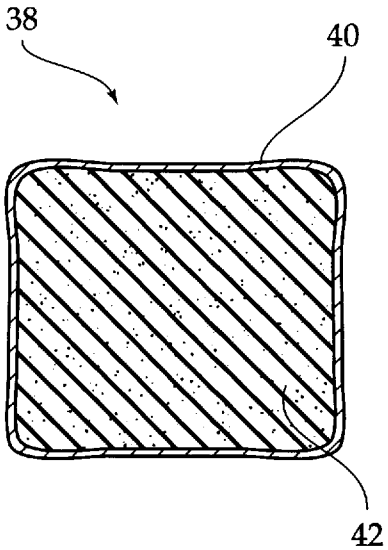
FIG. 4 is a cross-sectional view of the present invention as taken along line 4—4 of FIG. 2.
Figure 3:
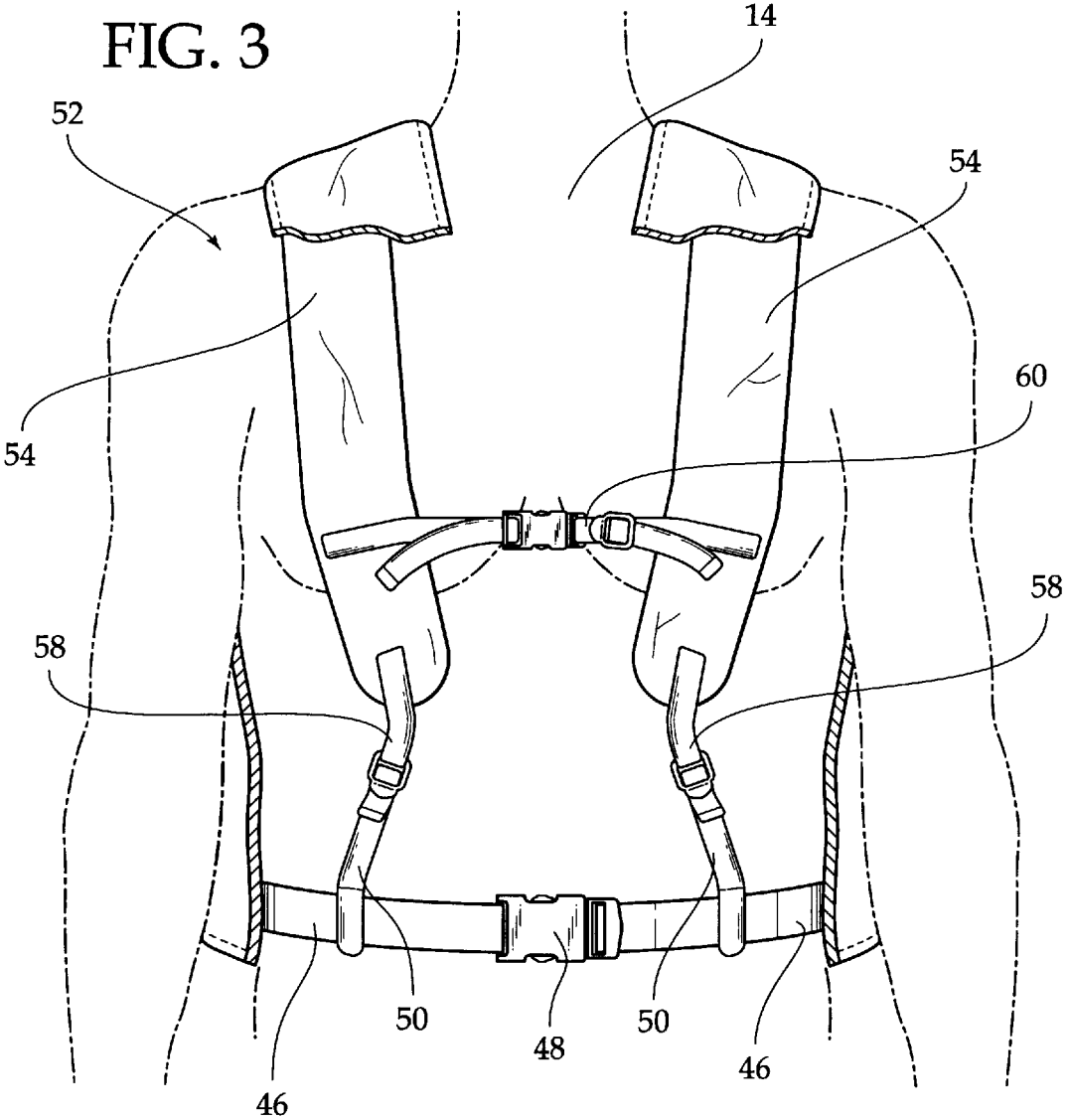
FIG. 3 is a front view of the present invention illustrating the interior of the vest portion thereof.
Figure 5:
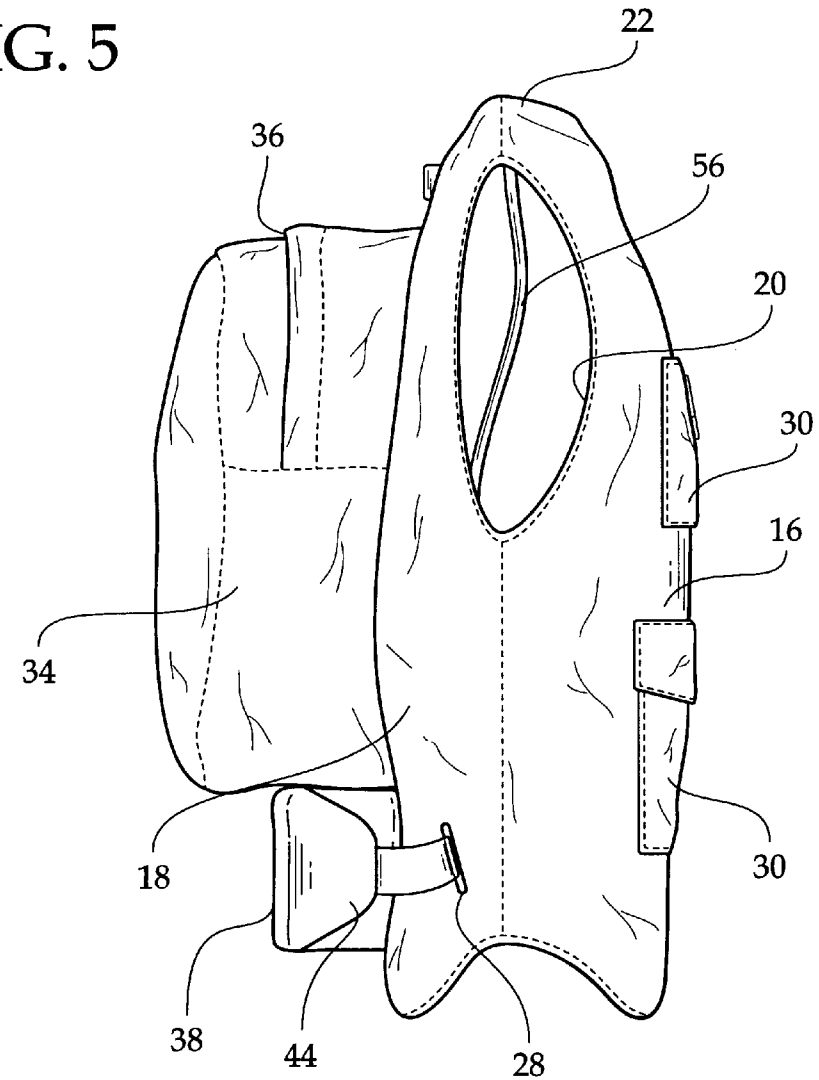
FIG. 5 is a side elevation view of the present invention.

With reference now to the drawings, and in particular, to FIGS. 1 through 5 thereof, the preferred embodiment of the new and improved vest with incorporated back pack and back support embodying the principles and concepts of the present invention and generally designated by the reference number 10 will be described.

Specifically, it will be noted in the various Figures that the device relates to a vest with incorporated back pack and back support for providing functionality of a traditional back pack while equally distributing weight loads on a person's shoulder and hips. In its broadest context, the device consists of a vest portion, a backpack portion, a lower back support, and a pair of shoulder supports. Such components are individually configured and correlated with respect to each other so as to attain the desired objective.

The vest portion 12 is adapted for being worn on a torso 14 of a user. The vest portion 12 is comprised of a front panel 16 and a back panel 18 each having outer edges. The outer edges are secured together leaving arm receiving openings 20 and a head receiving opening 22. The front panel 16 is defined by a pair of separable equally sized portions 24 each having inner edges. The inner edges are coupled together by a zippered closure 26. Note, that other types of closure could be utilized. The back panel 18 has a pair of slotted openings 28 therethrough inwardly of the outer edges thereof. The front panel 16 has a plurality of pockets 30 and a D-ring 32 disposed thereon. The pockets 30 can be of varying size and dimensions for carrying an assortment of items.

The backpack portion 34 is secured to the back panel 18 of the vest portion 12. The backpack portion 34 has an open upper end having a zippered closure 36. Other types of closure could also be utilized. The backpack portion 34 has a hollow interior for receiving items therein.

The lower back support 38 is securable to the back panel 18 of the vest portion 12 below the backpack portion 34. The lower back support 38 has a generally rectangular configuration. The lower back support 38 is comprised of a fabric outer layer 40 and a padded interior 42. The lower back support 38 has opposed ends 44. The opposed ends 44 each have a strap 46 extending outwardly therefrom. The straps 46 have free ends extending through the slotted openings 28 of the back panel 18 for wrapping around a waist of a wearer. The free ends have corresponding male and female fasteners 48 for securement around the waist of the wearer. The straps 46 each have a vertically oriented strap 50. The lower back support 38, as positioned, will provide needed support to the lower back of the user when heavy items are being carried within the backpack portion 34.

The pair of shoulder supports 52 are secured interiorly of the vest portion 12. Note FIG. 3. Each of the shoulder supports 52 include a front portion 54 and a back portion 56. The back portions 56 are fixedly secured to the back panel 18 of the vest portion 12. The front portions 16 each have a securement strap 58 for securing to the vertically oriented straps 50 of the lower back support 38. The front portions 54 are coupled together by an adjustable strap 60.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A vest with incorporated back pack and back support for providing functionality of a traditional back pack while equally distributing weight loads on a person's shoulder and hips comprising, in combination:

a vest portion adapted for being worn on a torso of a user, the vest portion being comprised of a front panel and a back panel each having outer edges, the outer edges being secured together leaving arm receiving openings and a head receiving opening, the front panel being defined by a pair of separable equally sized portions each having inner edges, the inner edges being coupled together by a zippered closure, the back panel having a pair of slotted openings therethrough inwardly of the outer edges thereof, the front panel having a plurality of pockets and a D-ring disposed thereon;

a backpack portion secured to the back panel of the vest portion, the backpack portion having an open upper end having a zippered closure, the backpack portion having a hollow interior for receiving items therein;

a lower back support securable to the back panel of the vest portion below the backpack portion, the lower back support having a generally rectangular configuration, the lower back support being comprised of a fabric outer layer and a padded interior, the lower back support having opposed ends, the opposed ends each having a strap extending outwardly therefrom, the straps having free ends extending through the slotted openings of the back panel for wrapping around a waist of a wearer, the free ends having corresponding male and female fasteners for securement around the waist of the wearer, the straps each having a vertically oriented strap;

a pair of shoulder supports secured interiorly of the vest portion, each of the shoulder supports including a front portion and a back portion, the back portions being fixedly secured to the back panel of the vest portion, the front portions each having a securement strap for securing to the vertically oriented straps of the lower back support, the front portions being coupled together by an adjustable strap.

2. A vest with incorporated back pack and back support for providing functionality of a traditional back pack while equally distributing weight loads on a person's shoulder and hips comprising, in combination:

a vest portion adapted for being worn on a torso of a user, the vest portion being comprised of a front panel and a back panel each having outer edges, the outer edges being secured together leaving arm receiving openings and a head receiving opening, the back panel having a pair of slotted openings therethrough inwardly of the outer edges thereof;

a backpack portion secured to the back panel of the vest portion;

a lower back support securable to the back panel of the vest portion below the backpack portion;

a pair of shoulder supports secured interiorly of the vest portion.

3. The vest with incorporated back pack and back support as set forth in claim 2 wherein the front panel of the vest portion is defined by a pair of separable equally sized portions each having inner edges, the inner edges being coupled together by closure means.

4. The vest with incorporated back pack and back support as set forth in claim 2 wherein the front panel has a plurality of pockets and a D-ring disposed thereon.

5. The vest with incorporated back pack and back support as set forth in claim 2 wherein the backpack portion has an open upper end having closure means, the backpack portion having a hollow interior for receiving items therein.

6. The vest with incorporated back pack and back support as set forth in claim 2 wherein the lower back support has a generally rectangular configuration, the lower back support being comprised of a fabric outer layer and a padded interior, the lower back support having opposed ends.

7. The vest with incorporated back pack and back support as set forth in claim 6 wherein the opposed ends of the lower back support each have a strap extending outwardly therefrom, the straps having free ends extending through the slotted openings of the back panel for wrapping around a waist of a wearer, the free ends having corresponding male and female fasteners for securement around the waist of the wearer.

8. The vest with incorporated back pack and back support as set forth in claim 2 wherein each of the shoulder supports including a front portion and a back portion, the back portions being fixedly secured to the back panel of the vest portion, the front portions each having a securement strap for securing to the lower back support, the front portions being coupled together by an adjustable strap.

* * * * *